US006182589B1

(12) United States Patent
Anderegg et al.

(10) Patent No.: US 6,182,589 B1
(45) Date of Patent: Feb. 6, 2001

(54) DRIVING APPARATUS FOR AN OSCILLATING CATCHER OF A SEWING MACHINE

(75) Inventors: Christian Anderegg, Frauenfeld; Andre Stucki, Steckborn, both of (CH)

(73) Assignee: Fritz Gegauf AG Bernina-Nahmaschinefabrik, Steckborn (CH)

( * ) Notice: Under 35 U.S.C. 154(b), the term of this patent shall be extended for 0 days.

(21) Appl. No.: 09/541,181

(22) Filed: Apr. 3, 2000

(30) Foreign Application Priority Data

May 7, 1999 (CH) ..... 0859/99
Dec. 10, 1999 (CH) ..... 2272/99

(51) Int. Cl.[7] ..... D05B 57/12; D05B 57/38

(52) U.S. Cl. ..... 112/220; 112/192

(58) Field of Search ..... 112/220, 192, 112/284, 189, 201, 194, 169

(56) References Cited

U.S. PATENT DOCUMENTS

| | | | | |
|---|---|---|---|---|
| 1,613,605 | * | 1/1927 | Corrall et al. | 112/220 |
| 2,325,467 | * | 7/1943 | Beyer | 112/192 |
| 3,029,762 | * | 4/1962 | Szuba et al. | 112/192 |
| 5,396,853 | * | 3/1995 | Huang | 112/169 |
| 6,032,597 | * | 1/1927 | Inagaki | 112/220 |

* cited by examiner

*Primary Examiner*—Ismael Izaguirre
(74) *Attorney, Agent, or Firm*—Edwin D. Schindler

(57) ABSTRACT

A driving apparatus for an oscillating catcher of a sewing machine includes a toothed pinion being eccentrically mounted on a driving shaft for the catcher for the sewing machine. A transmission device, having teeth, is guided in a back-and-forth movement by an oscillating crank drive, with the teeth of the transmission device engaging the tooth pinion on the driving shaft. By arranging the toothed driving gear eccentrically on the driving shaft of the catcher, it is possible to substantially increase the speed of the point of the catcher when it seizes the loop of the upper thread offered by the needle.

16 Claims, 5 Drawing Sheets

DRIVING APPARATUS FOR AN OSCILLATING CATCHER OF A SEWING MACHINE

BACKGROUND OF THE INVENTION

1. Technical Field of the Invention

The present invention relates, generally, to a driving apparatus for an oscillating catcher of a sewing machine.

More particularly, the present invention relates to a driving apparatus for an oscillating catcher of a sewing machine, which is capable of providing greater stitching security and/or a greater stitching width during the sewing of a zig-zag stitching procedure than comparable devices currently known to the art.

2. Description of the Prior Art

Various designs for driving devices for oscillating catchers are known in the prior art. The function of such driving devices is to place the catcher of the sewing machine into an oscillating rotational motion for the purpose of seizing with the point of the catcher of the loop of the upper thread, as well as for guiding the catcher about the spool capsule. The catcher is driven, in most cases, with a crank, which is put into motion by a revolving, or oscillating driving element. In many cases, the crank is driven via a toothed rack, or a toothed gear, mounted on a driving shaft of the catcher.

In Switzerland Patent No. 241,880, the toothed rack is guided tangentially relative to the toothed gear in a longitudinal guide, and driven via a connecting rod secured on a crank.

In United Kingdom Patent Specification No. 1,035,881, the teeth of the toothed rack of the apparatus disclosed therein are directly formed on an extension of a connecting rod. The connecting rod is put into an oscillating motion via a swinging lever. The two driving devices taught in this prior art reference can be employed for both horizontally and vertically oscillating catchers.

The driving devices of the types specified in the foregoing prior art have the distinct drawback that an attainable rotational speed for the catcher is relatively low at the moment that the loop is picked up by the point of the catcher. However, the rotational speed of the catcher cannot be varied at will with conventional devices known to the prior art, because the driving movements of the needle bar and of the catcher of a double-stitch sewing machine have to be synchronized. As long as the needle moves in a central position, i.e., in the zero position, and is therefore not deflected sideways for zig-zag sewing, the movements of the catcher exactly match the position of the needle.

The loop of the upper thread can be securely seized and uniformly guided. When zig-zag seams are sewn, the phase position between the eye of the needle and the point of the catcher changes at the moment that the loop is taken over by the catcher, depending upon the contemporaneous lateral position of the needle, i.e., at the moment of its lateral deflection from the center position. This is because, while the point of the catcher is moving past the needle for seizing the loop of the upper thread offered by the needle, the needle is already moving upwards. This lateral displacement of the needle during zig-zag sewing necessarily changes the spacing between the eye of the needle and the point of the catcher. If this spacing is smaller or larger than the nominal (or rated) spacing, faulty stitches may occur, because the shape and size of the loop of the thread changes with the deflection, as well, and the point of the catcher will not pick up the loop in the most unfavorable case.

The maximally achievable zig-zag width, i.e., the deflection of the needle, is influenced by, and/or upwardly limited by, the deviation of the phase position between the eye of the needle and the point of the catcher. The effects of such phase displacement are described and illustrated in the handbook by Renters, entitled *Der Naehmaschinen-Fachmann*, which translates to *The Sewing Machine Expert*, in English. The relevant portions of this reference are found in Volume 3, published in 1957.

In summation, it becomes clear that a greater zig-zag width would be attainable if the deviations from the conditions present when a straight seam is sewn did not exist.

The foregoing discussion makes clear that the stitching security and the maximally achievable stitching width during zig-zag sewing are very strongly influenced by the speed of the relative movements between the needle and the catcher. Both the translatory movement of the needle bar and the needle, and the oscillating motion of the catcher take place in non-uniform ways, conditioned by the movement pattern (acceleration/deceleration) of their crank drives. In order to improve the motional conditions within the range in which the loop of the thread is picked up by the point of the catcher, or to reduce the phase shift between the eye of the needle and the point of the catcher in said range, it would be necessary to either retard the movement of the needle or to increase the speed at which the catcher is moving.

SUMMARY OF THE INVENTION

It is, therefore, an object of the present invention to provide a driving apparatus for an oscillating catcher of a sewing machine having greater stitching security and/or a greater stitching width during a zig-zag sewing procedure.

The foregoing and related objects are achieved by the driving apparatus of the present invention for an oscillating catcher of a sewing machine, in which the driving apparatus includes a toothed pinion being eccentrically mounted on a driving shaft for the catcher for the sewing machine. Transmission means, having teeth, is guided in a back-and-forth movement by an oscillating crank drive, with the teeth of the transmission means engaging the tooth pinion on the driving shaft.

By arranging the toothed driving gear eccentrically on the driving shaft of the catcher, it is possible to substantially increase the speed of the point of the catcher when it seizes the loop of the upper thread offered by the needle. The angular position of the highest eccentricity of the toothed gear, with respect to the point of the catcher, is selected in this connection so that the point of the catcher is moving past the needle within a given range, or at the time when the loop is being picked up, at the highest possible speed. The pinion eccentrically mounted on the driving shaft of the catcher can be manufactured economically. For the purpose of guiding the toothed rack on the toothed gear, it is possible to make provision for a guiding disk arranged coaxially with the eccentrically-positioned tooth gear; the tooth gear preventing the toothed rack from lifting off the toothed gear with the aid of an abutting guide.

In an alternative embodiment of the present invention, the toothed rack, which is preferably formed on the end of a connecting rod, is kept engaged with the teeth of the toothed gear by a spring force.

In another advantageous embodiment of the present invention, the speed curve of the point of the catcher during pick-up of the loop of the thread can be further optimized if the teeth of the toothed rack are arranged along a curved line. The use of a toothed belt as a transmission means was found to be advantageous with respect to concern about the generation of noise.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
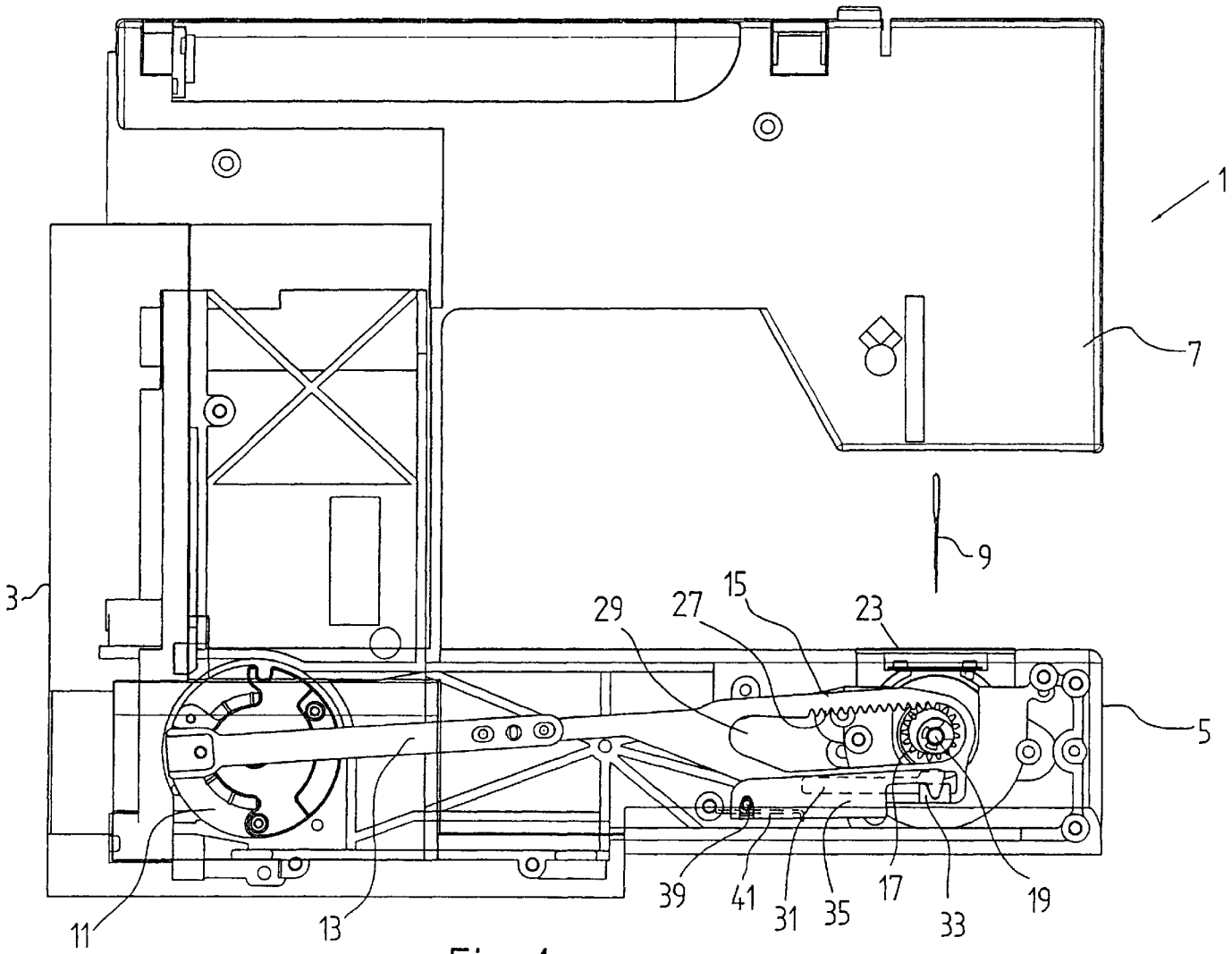
FIG. 1 shows a side view of a free-arm sewing machine with the free arm shown as cut open longitudinally, providing a view of the extreme rear position of the toothed rack.

Turning now, in detail, to an analysis of the accompanying drawing figures, a sewing machine 1 is schematically shown in FIG. 1, in a side view, which illustrates a sewing machine housing 3, on which a free arm 5 is attached at the bottom thereof; a head 7 for holding a presser foot; and, a needle bar attached at the top. For the sake of greater clarity, FIG. 1 shows solely a needle 9 without its needle bar, in order to illustrate its approximate position.

In free arm 5, which is cut open laterally, it is possible to see (on the left side) a crank drive 11 with a connecting rod 13 articulated on crank drive 11. A toothed rack 15 is located at the front end of connecting rod 13. Toothed rack 15 mates with a toothed gear or a toothed pinion 17, which is eccentrically mounted on a driving shaft 19 for a catcher 21. A stitching plate 23 is visible above catcher 21, with needle 9 being able to be guided through a stitching hole 25 of said stitching plate. Crank drive 11 is put into rotation by a motor (not shown.) The crank drive is designed to operate synchronously with the drive for the needle bar (not shown) and its needle 9, which is secured on said needle bar.

In FIG. 1, crank drive 11, with toothed rack 15 mounted thereon, is located in the rear position, with needle 9 not engaging the material (not shown) being sewn.

Figure 2:
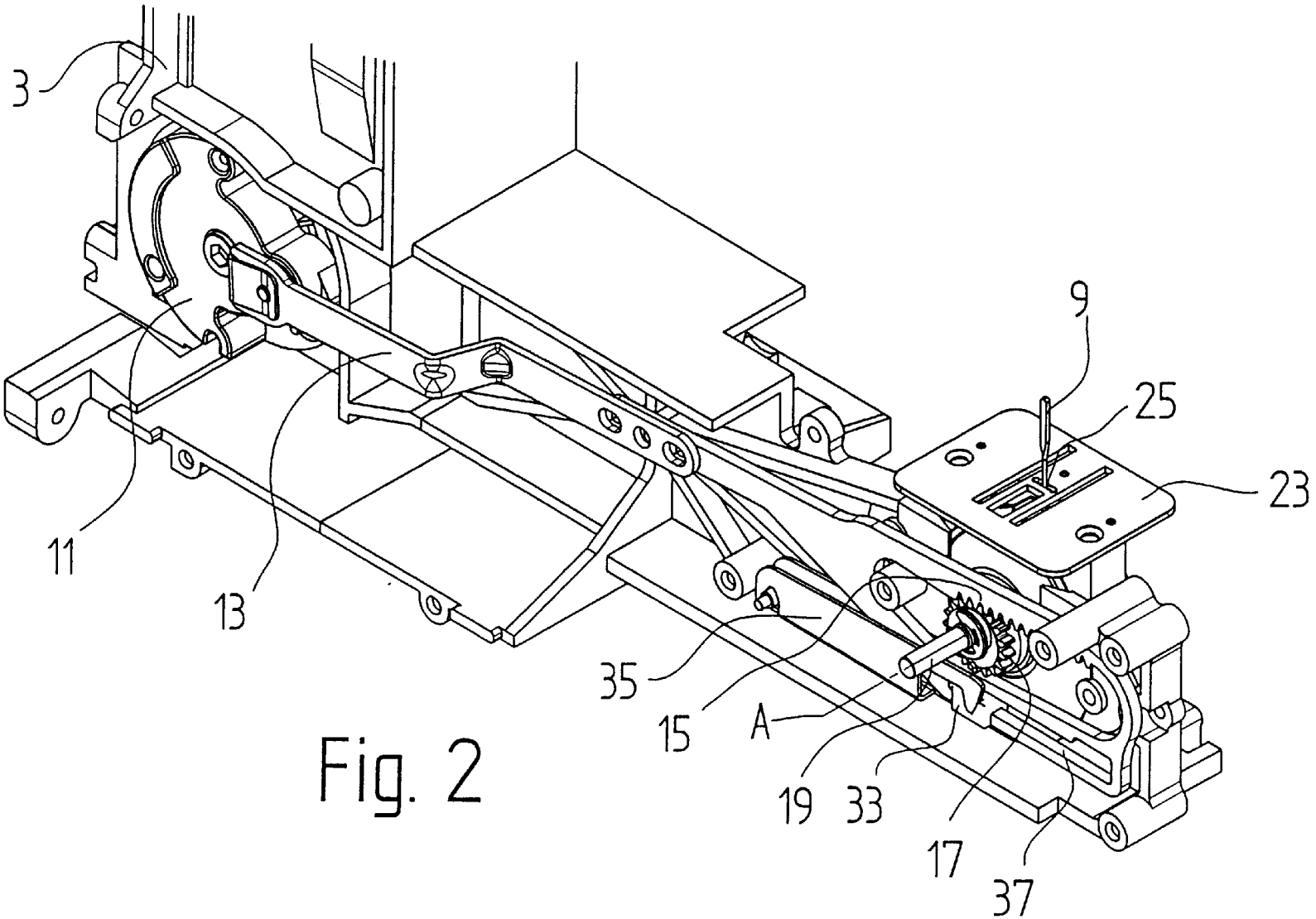
FIG. 2 is a perspective view of the free arm, with the housing therefor being omitted, showing the toothed rack located in the extreme frontal position.

In FIG. 2, needle 9 is immersed in the stitching plate 23 through stitching hole 25, and toothed rack 15 has reached its extreme front and reversing position. In the extreme front position, the teeth of the toothed pinion 17, engaging the toothed rack 15, are those that have the smallest spacing from the axis A of driving shaft 19. This means that the greatest translation between crank drive 11, i.e., the main drive and, thus, the highest rotational speed, are achieved within said range. As the spacing of the teeth of the toothed rack 17 from axis A increases, the transmission ratio decreases, and reaches a minimum when the toothed rack 15 mates with the teeth having the largest spacing from the axis A. This position is reached shortly after crank drive 13 has vacated the rear dead and reversing position.

In the first preferred according to FIGS. 1 and 2, the teeth 27 of toothed bar 15 are located within a loop-shaped recess 29, located at the end of connecting rod 13. The zone at the end of the connecting rod, opposing teeth 27, has a slot-like opening 31, extending substantially parallel with the ridges of the teeth. A sliding block 33, designed for lengthwise travel, is inserted in said slot-shaped opening and is pressed against the lower limiting surface 37 of slot-like opening 31, by way of a depressing element 35. Depressing element 35, preferably, comprises two legs disposed parallel with each other, with each of said legs coming to rest laterally of slot-like opening 31, covering the same laterally. Depressing element 35 is articulated with one end on a pivoting axle 39 and is pressed clockwise onto sliding block 33 by a spring 41. The force of spring 41 is dimensioned so that it suffices for keeping teeth 27 of toothed rack 15, at all times, safely engaged with the teeth of tooth pinion 17.

Figure 3:
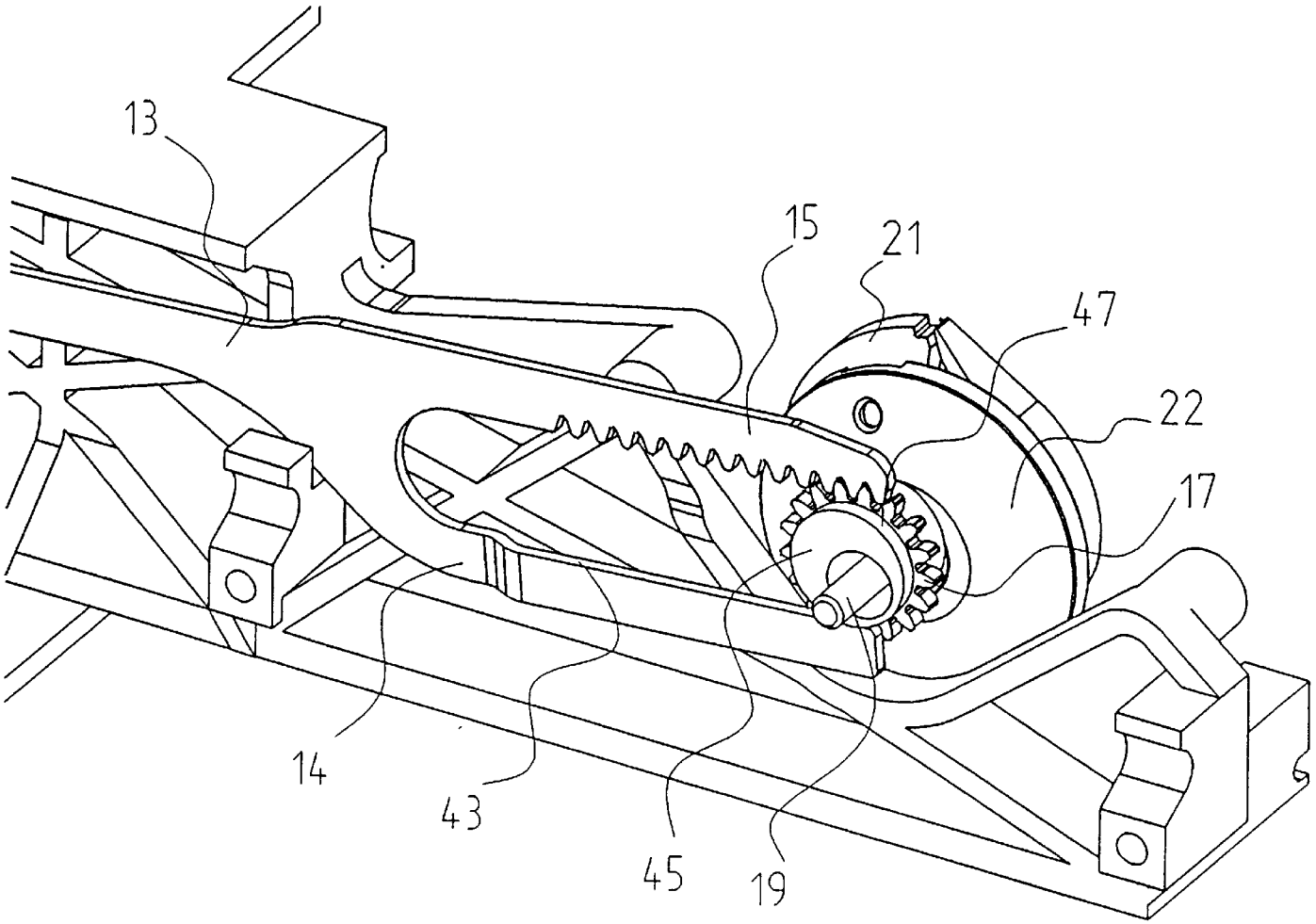
FIG. 3 is a perspective view of a catcher drive having an open fork and a toothed rack guide on an eccentrically supported disk.

In a second preferred embodiment according to the present invention, as illustrated in FIG. 3, the toothed rack 15 is guided on toothed pinion 17 by the guiding edge 43, located on a fork-line end 14 of connecting rod 13. Acting as a counter-guide against guiding edge 43, a circular disk 45 is shaped by molding onto the face side of toothed pinion 17, and disposed concentrically relative to the latter. The periphery of circular disk 45 functions as a guiding surface. Circular disk 45 is, preferably, produced as an element integrally formed with toothed pinion 17, and is mounted with the same eccentricity on driving shaft 19 of the catcher driver 22. This arrangement assures that the spacing of the flanks of the teeth, which engage toothed rack 15, and the line of contact between the periphery 47 of circular disk 45, with guiding surface 43, always remains constant at the fork-like end 14 of connecting rod 13. The connecting rod 13, with toothed rack 15 and guiding surface 43, can be guided sideways by a disk (not shown in FIG. 3) mounted on driving shaft 19; said disk preventing the fork-like end 14 from moving sideways in the direction of the axis A. Such a disk would only slide on the lower leg of the fork-shaped end 14 of connecting rod 13, because this end is laterally offset against the end of the fork containing toothed rack 15.

Connecting rod 13 with toothed rack 15 is, preferably, manufactured in the form of a precisely cut, punched part and, therefore, can be produced with high precision and at an extremely favorable cost.

Figure 4:
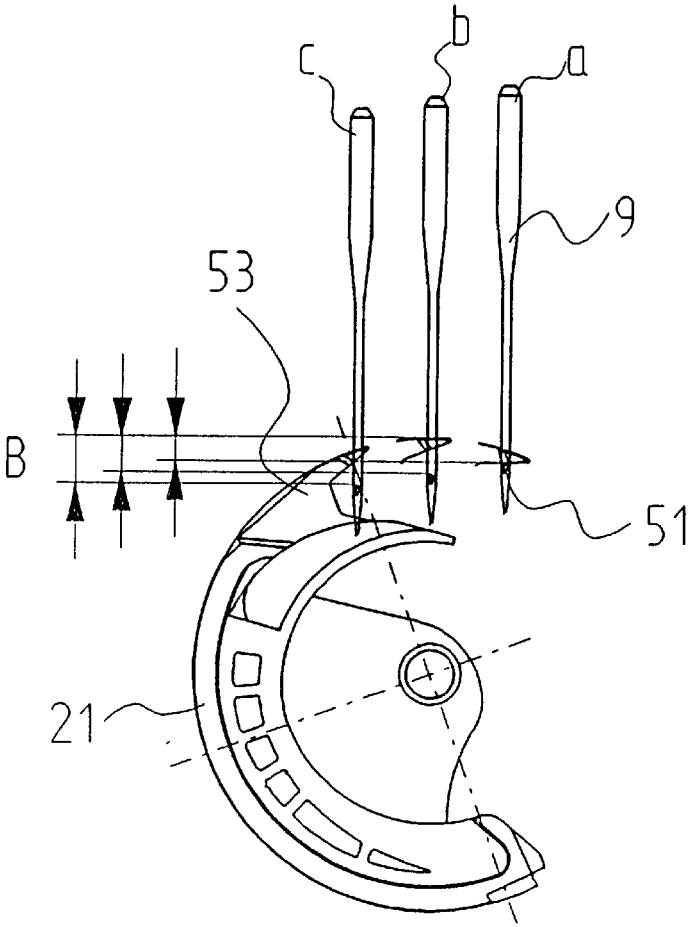
FIG. 4 is a schematic side view of the catcher of the sewing machine with three needle positions during stitching; and, FIG. 5 is a side view of a further, preferred embodiment of a free-arm sewing machine, with the free arm being shown as cut open longitudinally.

FIG. 4 shows a schematic representation of the position of the needle 9 in the three possible puncturing positions with respect to catcher 21 or the point 53 of the latter. In position a, the positions of the needle 9 and catcher 21 can be seen during puncturing on the right. The position b shows the positions of catcher 21 and needle 9 during center puncturing, as it is used for straight seems. Finally, in position c, needle 9 and catcher 21 are shown in the puncturing position left. This representation clearly shows that the spacing B between the needle eye 51 and the catcher point 53 varies (i.e., different phase positions) depending upon the lateral position of needle 9. By increasing the rotational speed of catcher 21 and, thus, of point 53, arranged on catcher 21, what is achieved is that said point can pick up the loop of the thread more rapidly, which increases the stitching safety when needle 9 is in the greatest possible lateral position.

Figure 5:
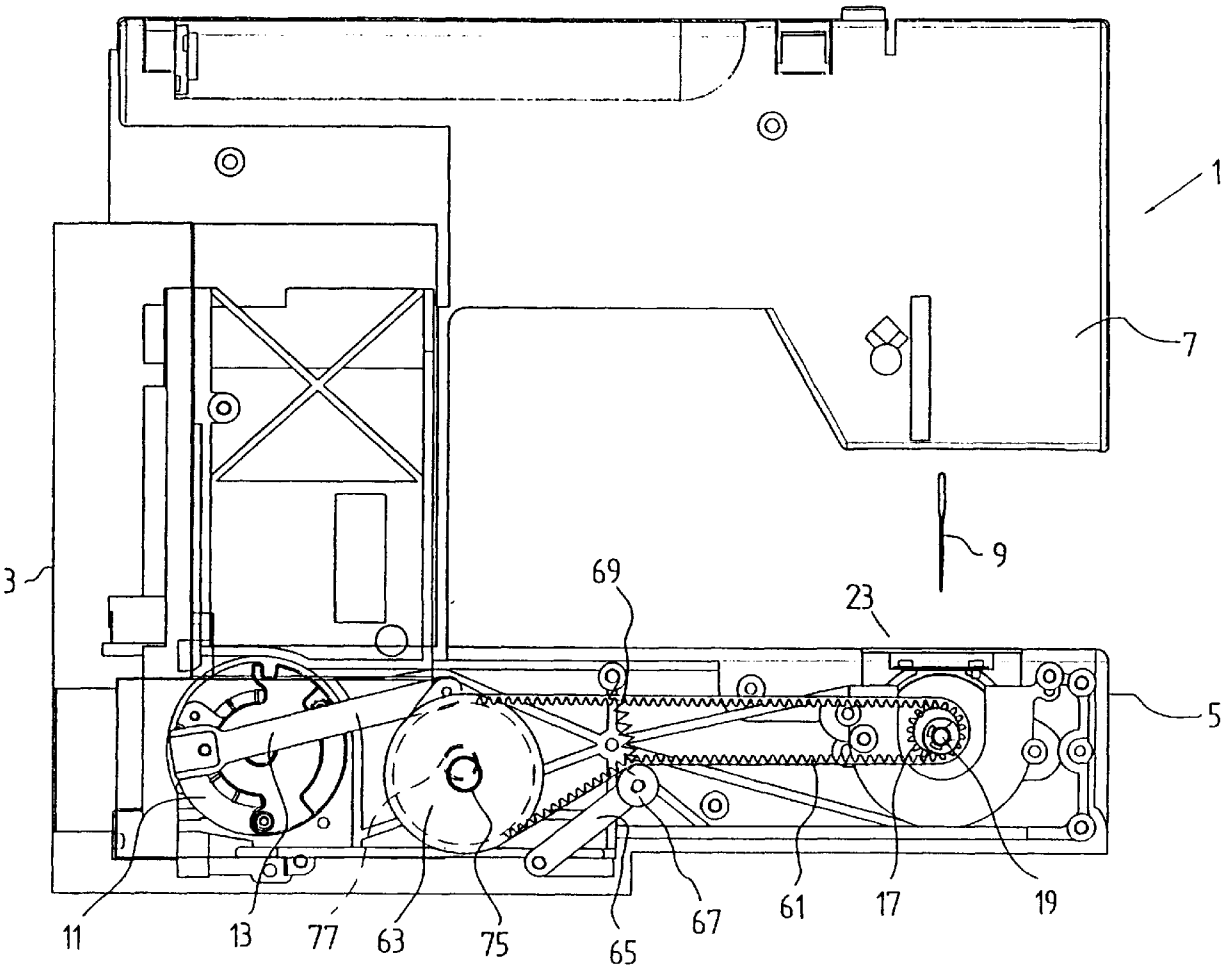

In the preferred embodiment illustrated in FIG. 5, the toothed rack is replaced by a toothed belt 61 which can be looping around the eccentrically supported toothed pinion 17, but which can also loop around a toothed driven gear 63 rotatably supported on an axle 75; said toothed driven gear 63 being drivable in an oscillating manner by connecting rod 13. A belt tensioning lever 65, with a tensioning roller 67 loaded by a spring 69, compensates for the changes in the looping length of toothed belt 61, such changes being caused by the eccentricity of toothed pinion 17. The changes in the looping length are very minor, because the eccentricity of the toothed pinion 17 is extremely small.

Alternatively, or additionally, it is also possible to eccentrically support toothed gear 63 on axle 77. Instead of using the toothed pinion and toothed gears 17, 63, it would also be possible to employ segment-like belt carriers, because the oscillating stroke performed by the toothed belt 61 is, in any case, only very limited.

While only several embodiments of the present invention have been shown and described, it will be obvious to those skilled in the art that many modifications may be made to the present invention without departing from the spirit and scope thereof.

What is claimed is:

1. A driving apparatus for an oscillating catcher of a sewing machine, comprising:

a catcher with a driving shaft;

a toothed pinion eccentrically mounted on said driving shaft of said catcher;

an oscillating crank drive; and, transmission means guided in a back-and-forth motion by said oscillating crank drive, said transmission means having teeth for engaging teeth of said tooth pinion.

2. The driving apparatus for an oscillating catcher of a sewing machine according to claim 1, wherein said transmission means is a toothed rack positioned between said oscillating crank drive and said tooth pinion.

3. The driving apparatus for an oscillating catcher of a sewing machine according to claim 2, wherein said tooth rack includes a guiding surface constructed for retaining engagement of said toothed rack with said toothed pinion.

4. The driving apparatus for an oscillating catcher of a sewing machine according to claim 3, wherein said oscillating crank drive has a connecting rod with said guiding surface being formed within a slotted opening at an end of said connecting rod of said oscillating crank drive, said slotted opening being arranged below said toothed rack.

5. The driving apparatus for an oscillating catcher of a sewing machine according to claim 3, wherein said guiding surface slidingly abuts a guide disk coaxially mounted on said driving shaft of said catcher.

6. The driving apparatus for an oscillating catcher of a sewing machine according to claim 5, wherein said guiding surface is constructed as a face-side axial extension of said toothed pinion.

7. The driving apparatus for an oscillating catcher of a sewing machine according to claim 5, wherein said guiding surface is mounted on said driving shaft of said catcher as a separate component.

8. The driving apparatus for an oscillating catcher of a sewing machine according to claim 1, wherein said oscillating crank drive has a connecting rod with a guiding edge located on said connecting rod, with a spring-loaded sliding shoe being supported with longitudinal displaceability on said guiding edge of said connecting rod.

9. The driving apparatus for an oscillating catcher of a sewing machine according to claim 8, wherein said transmission means is a toothed rack positioned between said oscillating crank drive and said tooth pinion, with said guiding edge of said connecting rod ending substantially parallel with teeth of said toothed rack.

10. The driving apparatus for an oscillating catcher of a sewing machine according to claim 8, wherein said sliding shoe is depressable onto said guiding edge of said connecting rod by a spring-loaded lever.

11. The driving apparatus for an oscillating catcher of a sewing machine according to claim 1, wherein said transmission means is a toothed belt positioned between said oscillating crank drive and said tooth pinion.

12. The driving apparatus for an oscillating catcher of a sewing machine according to claim 1, wherein said transmission means is a toothed belt looping around said toothed pinion.

13. The driving apparatus for an oscillating catcher of a sewing machine according to claim 1, wherein said transmission means is a toothed belt looping around a toothed gear, said toothed gear being drivable in an oscillating manner by said oscillating crank drive.

14. The driving apparatus for an oscillating catcher of a sewing machine according to claim 13, wherein said toothed gear is eccentrically supported on an axle.

15. The driving apparatus for an oscillating catcher of a sewing machine according to claim 1, wherein said transmission means is a toothed belt looping around a belt carrier, said belt carrier being drivable in an oscillating manner by said oscillating crank drive.

16. The driving apparatus for an oscillating catcher of a sewing machine according to claim 1, wherein said transmission means is a toothed belt, said toothed belt being maintained in a tensioned manner with a spring-loaded tensioning lever and a tensioning roller secured on aid spring-loaded tensioning lever.

* * * * *